United States Patent [19]

Gruenewaelder et al.

[11] Patent Number: 4,774,004

[45] Date of Patent: Sep. 27, 1988

[54] PROCESS FOR FILTERING LIQUORS USED IN DRY CLEANING

[75] Inventors: Werner Gruenewaelder, Haan; Margarete Schaefer, Langenfeld; Winfried Wichelhaus, Mettmann; Wolfgang von Rybinski, Duesseldorf, all of Fed. Rep. of Germany

[73] Assignee: Henkel Kommanditgesellschaft auf Aktien, Duesseldorf, Fed. Rep. of Germany

[21] Appl. No.: 879,713

[22] Filed: Jun. 27, 1986

[30] Foreign Application Priority Data

Jun. 27, 1985 [DE] Fed. Rep. of Germany ..... 3522932

[51] Int. Cl.[4] ..... B01D 37/02

[52] U.S. Cl. ..... 210/663; 210/690; 210/777

[58] Field of Search ..... 210/777, 778, 502.1, 210/504, 506, 660, 663, 690; 502/407–413

[56] References Cited

U.S. PATENT DOCUMENTS 3,368,678 2/1968 Gilbert ..... 210/506
4,386,010 5/1983 Hildebrandt ..... 252/428

FOREIGN PATENT DOCUMENTS 0035198 7/1983 European Pat. Off. .
WO83/01206 4/1983 World Int. Prop. O. .

OTHER PUBLICATIONS

FCR Information No. 174, published Jul. 1977, for the Research Institute on Chemical Cleaning.

Chemical Abstract, vol. 75, 14420, (1971).

*Primary Examiner*—Ivars Cintins
*Attorney, Agent, or Firm*—Ernest G. Szoke; Henry E. Millson, Jr.; Real J. Grandmaison

[57] ABSTRACT

This invention relates to a process for the filtration of liquors containing organic solvents in dry cleaning using natural and/or synthetic layered silicates prepared with one or more ammonium compounds corresponding to the following general formula $$R^1R^2R^3R^4N^+X^- \quad (I)$$

wherein $R^1$, $R^2$, $R^3$ and $R^4$ represent hydrogen, alkyl or alkenyl groups which may optionally be substituted and X—represents anions of water-soluble, highly dissociated acids, in a quantity of from 2 to 60% by weight.

Settling filters or cartridge filters are charged with the layered silicates thus prepared either alone or in combination with kieselguhr and/or active carbon, and solvent mixtures used in dry cleaning are filtered through the prepared filters.

The invention also relates to filtration aids for use in the filtration of cleaning liquors from dry cleaning systems which are characterized in that they comprise natural and/or synthetic layered silicates prepared with quaternary ammonium compounds corresponding to general formula (I) above in a quantity of from 2 to 60% by weight, in combination with kieselguhr and/or active carbon.

12 Claims, No Drawings

PROCESS FOR FILTERING LIQUORS USED IN DRY CLEANING

BACKGROUND OF THE INVENTION

1. Field of the Invention

This invention relates to a process for the filtration of liquors containing organic solvents used in dry cleaning. The invention also relates to filtration aids used in the filtration of these liquors.

2. Description of Related Art

In dry cleaning, soil is detached from fabrics and leather goods by cleaning liquors predominantly containing organic solvents. To enable the solvents to be reused, the various soils detached, which are either dispersed or dissolved in the organic solvents, have to be completely removed from the solvents without the composition of the cleaning liquors being significantly affected.

In corresponding processes for treating solvents used in dry cleaning, all filterable, i.e. undissolved, impurities have to be removed from the solvent in a first step. This is normally done in filters charged with kieselguhr. In kieselguhr filters, however, only undissolved soil is filtered off from the cleaning liquors.

If cartridge filters are used for filtering the soiled cleaning liquors, the filtration result is much better. Typically, the cartridges of such filters contain active carbon or mixtures of active carbon and activated alumina, e.g., bentonite. Materials such as these not only have a very large surface area, they also show a good adsorption effect with respect to dissolved soil. Accordingly, the cleaning liquors filtered through these materials are much cleaner than those filtered through kieselguhr, so that subsequent distillation of the cleaning liquors can be carried out at longer intervals. Cartridge filters of the type in question are described, for example, in current FCR-Information No. 174 of the Forschungsstelle Chemischreinigung, published in July, 1977.

Unfortunately, the surfactant content of certain cleaning liquors causes problems in adsorption filters of the type in question. Surfactants emanating, for example, from prespotting are inadequately adsorbed. This results in an accumulation of prespotting agents and cleaning boosters in the cleaning liquors. So-called "rings" on thin fabrics, such as, for example, on linings or lightweight outer clothing, are the direct result (cf. WRP, No. 6/1982, pages 8 et seq.).

Distinct improvements in the kieselguhr filters described above are provided by the filters disclosed in DE-OS No. 30 07 633 which consist completely or partly of finely-divided, water insoluble, alkali metal alumino-silicates, i.e., zeolites. In some cases, these zeolite filters are used in combination with kieselguhr filters and, above all, enable even dissolved acid traces to be removed from the cleaning liquors. However, distillation of the solvent mixtures is unavoidable on account of the numerous dissolved soils.

The object of the present invention is mainly to free the solvents or solvent mixtures used in dry cleaning from dissolved soil, odorous substances and dyes, prespotting agents and cleaning boosters so that by improved filtration, distillation of the solvents is only necessary at prolonged intervals.

SUMMARY OF THE INVENTION

Accordingly, the present invention relates to a process for the filtration of liquors containing organic solvents used in dry cleaning using silicate-based filtration aids, wherein natural and/or synthetic layered silicates having an exchange capacity for cations of at least about 30 meq/100 g of layered silicate are prepared with one or more ammonium compounds corresponding to the following general formula $$R^1R^2R^3R^4N^+X^- \quad (I)$$

wherein $R^1$, $R^2$, $R^3$ and $R^4$ represent hydrogen, alkyl or alkenyl groups, two or three of the substituents $R^1$ to $R^4$ may be closed with inclusion of the nitrogen atom to form an aliphatic or aromatic heterocyclic ring system, the respective alkyl or alkenyl groups may be branched or unbranched and may contain cycloalkyl groups, aryl groups, ether bonds, amine bonds, amide bonds and ester bonds and may be substituted by hydroxyl groups or halide and contain from 1 to 18 carbon atoms, the total number of carbon atoms in the cation being greater than 12, and $X^-$ represents anions of water-soluble acids having a dissociation constant of greater than $10^{-5}$, in a quantity of from 2 to 60% by weight, based on the weight of the layered silicates. Settling filters or cartridge filters are charged with the layered silicates prepared in this way either alone or in combination with kieselguhr and/or active carbon, and solvent mixtures used in dry cleaning are filtered through these filters.

DETAILED DESCRIPTION OF THE INVENTION

The present invention also relates to filtration aids for use in the filtration of soiled cleaning liquors from dry cleaning systems which are characterized in that they comprise natural and/or synthetic layered silicates corresponding to general formula (I) above in a quantity of from 2 to 60% by weight in combination with kieselguhr and/or active carbon.

Other than in the operating examples, or where otherwise indicated, all numbers expressing quantities of ingredients or reaction conditions used herein are to be understood as modified in all instances by the term "about."

Numerous silicate materials of natural and/or snythetic origin may be used as the layered silicates. Mica-like layered silicates having a 3-layer structure from the smectite group are particularly suitable for use in the process according to the invention, although vermiculites and the sodium phyllosilicates which belong to the non-mica-like layered silicates are also suitable. The smectites include montmorillonite, saponite, beidellite and hectorite. Examples of phyllosilicates are kenyaite, magadiite, makatite and kanemite. It is preferred to use bentonites having a high montmorillonite or hectorite content, untreated natural bentonites or, optionally, natural bentonites in a form pretreated in known manner with acids or alkalis to remove troublesome cations.

The most important characteristic of the layered silicates suitable for use in accordance with this invention is their exchange capacity for cations. According to the invention, the cation exchange capacity of the layered silicates should be at least about 30 meq/100 g of layered silicate. Smectite clay minerals having a cation exchange capacity of from 50 to 120 meq/100 g of layerd silicate are particularly preferred.

Natural and/or synthetic layered silicates having the properties mentioned above are prepared in known manner with one or more long-chain ammonium compounds corresponding to general formula (I) above in a quantity of from 2 to 60% by weight, based on the total weight of the modified layered silicate. This may be done, for example, by treating the corresponding silicates with solutions of the required ammonium compounds in order to exchange alkali metal cations in the layered silicates for the ammonium cations. The layered silicates are prepared by treatment with quantities of ammonium compounds of preferably from 5 to 30% by weight, and more preferably of from 10 to 25% by weight, based on the weight of the treated layered silicates.

Ammonium compounds corresponding to general formula (I), which contain a total of from 14 to 38 carbon atoms, have proven to be particularly effective in the process according to this invention for filtering liquors from dry cleaning systems. Of these ammonium compounds, the quaternary ammonium compounds, i.e., compounds in which none of the substituents $R^1$ to $R^4$ is hydrogen, are particularly preferred. In another embodiment of the invention, particularly preferred compounds of general formula (I) are those in which at least two of the organic substituents R represent a $C_1$–$C_3$ alkyl group and one or two of the organic substituents R represent(s) a $C_9$–$C_{18}$ alkyl group. The anion $X^-$ represents anions of water-soluble acids having a dissociation constant of greater than $10^{-5}$, preferably chloride, bromide, acetate, hydrogen sulfate or hydrogen phosphate, but especially chloride. Lauryl-trimethylammonium chloride and distearyldimethylammonium chloride have proven to be particularly effective for the preparation of the natural and/or synthetic layered silicates. However, it is also possible with advantage to use other quaternary ammonium salts, for example, those containing aromatic substitutent R, such as, for example, cetyldimethylbenzylammonium chloride. Laurylpyridinium chloride is an example of a quaternary ammonium salt corresponding to general formula (I) in which the organic substituents R may be closed with inclusion of the nitrogen atom to form a heterocyclic ring system.

In the process according to the invention, the natural and/or synthetic layered silicates prepared with the ammonium compounds mentioned above are used to charge settling or cartridge filters, cartridge filters being particularly preferred. The charge may consist either exclusively of the prepared layered silicates mentioned above or, preferably, may contain additions of other, standard filtration aids, for example, kieselguhr and/or active carbon. Where mixtures of kieselguhr and layered silicate, or active carbon and layered silicate are used, the mixing ratio for the components mentioned is from 80:20 to 50:50, and preferably from 70:30 to 50:50.

The described filtration aids are much more suitable for use in the process according to the invention for the filtration of soiled liquors containing organic solvents used in dry cleaning than conventional adsorption filters containing kieselguhr, active carbon, zeolites or mixtures of these materials. The use of the instant filtration aids affords considerable advantages particularly when trichloroethylene, 1,1,1-trichloroethane, perchloroethylene, monofluorotrichloromethane, triflurotrichloroethane or mixtures of these solvents accumulate as soiled solvents in the cleaning liquors. The cleaning liquors may be almost completely freed from dissolved soil, odorous substances and dyes, prespotting agents and cleaning boosters. The distillation of the solvents which has to be carried out at frequent intervals in conventional filtration processes can now be carried out at much longer time intervals. Thus, not only can solvent be saved, energy costs can also be considerably reduced. The filtration aids which compose a mixture of layered silicate with kieselguhr or active carbon are distinguished at all times by particularly universal cleaning properties.

The invention is illustrated by the following examples.

EXAMPLE 1

Production of Prepared Layered Silicates

In a stirring vessel, 500 g Laponite RD (a synthetic hectorite made by Laporte Ind.) were dispersed in 10 liters of deionized water and heated to 60° C. A clear thixotropic gel was formed. 425 g Dehyquart LT (lauryltrimethylammonium chloride dissolved in water, approximately 35% active substance, a Henkel product) were slowly added with vigorous stirring, the organically modified hectorite flocculating out. The mixture was then stirred for 30 minutes to complete the reaction. The organically modified hectorite was filtered off under suction in a suction filter, washed with 2 liters of deionized water, and dried at 75° C. in a recirculating air drying cabinet. The product had a carbon content of 17.3% corresponding to approximately 27% lauryltrimethylammonium chloride.

EXAMPLE II

A cleaning liquor wherein the organic solvent component was trifluorotrichloroethane, contained 5 g per liter of tallow fatty acid and an anion-active cleaning booster having the following composition:

40% sodium dodecylbenzene sulfonate
10% potassium petroleum sulfonate
10% isopropanol
20% spindle oil, and
20% water.

The cleaning booster was dissolved in the cleaning liquor in a quantity of 7 g per liter of cleaning liquor.

To determine the adsorption of fatty acids and cleaning booster, the cleaning liquor was pump-circulated through a cartridge filter containing as filtration aid a mixture of:

60% granulated active carbon (particle diameter 1.5 mm) and
40% of the prepared layered silicate of Example I.

The layered silicate was a hectorite which had been charged with 27% by weight of lauryltrimethylammonium chloride.

After filtration for two hours, a sample of the treated liquor was removed and the fatty acid content and also the residual solids content were determined. The results are shown in Table 1.

COMPARISON EXAMPLE II

The cleaning liquor described in Example II was pump-circulated through a cartridge filter containing 60% granulated active carbon (particle diameter 1.5 mm) and
40% uncharged hectorite.

Under the same conditions as in Example II, a sample of the liquor was taken and the fatty acid and solids contents were determined. The results are shown in Table 1.

Comparison of Example II with Comparison Example II shows that, where the charged layered silicate was used, both the fatty acid content and also the solids content of the cleaning liquor could be greatly reduced; the cleaning booster could even be completely removed from the liquor. The uncharged layered silicate showed poorer results in all three cases.

EXAMPLE III

A cleaning liquor predominantly containing monofluorotrichloromethane as organic solvent contained as dissolved impurities stearic acid in a quantity of 10 g per liter and a nonionic cleaning booster having the following composition in a quantity of 5 g per liter:

10% nonylphenol containing 6 moles of ethylene oxide
25% cetylalcohol containing 9 moles of ethylene oxide
15% alkanolamide
15% butylglycol
15% white spirit, and
20% water.

As in Example II, this cleaning liquor was pump-circulated for 2 hours through a filter which had been charged with a mixture of 80% active carbon and 20% bentonite as filtration aid. The layered silicate had been charged with 60% by weight distearyldimethylammonium chloride.

On completion of filtration, a sample of the liquor was taken to determine the fatty acid cleaning booster and solids contents. The results are shown in Table 1.

COMPARISON EXAMPLE III

A cleaning liquor having the same composition as in Example III was passed through a filter containing 80% active carbon and 20% uncharged bentonite as filtration aids.

Under the same test conditions as in Example III, samples of the cleaning liquor were taken after filtration to determine the contents of the soil components mentioned in Example III. The results are set out in Table 1.

Comparison of Example III with Comparison Example III shows that filtration with the prepared layered silicate produced considerably better filtration results; i.e., the quantities of dissolved impurities amounted to only a fraction of the impurities remaining after filtration with non-prepared layered silicate.

EXAMPLE IV

A heavily soiled and discolored liquor sample was taken from a dry cleaning machine operated in the usual way. The cleaning liquor additionally contained 8 g of oleic acid, and 5 g of a cleaning booster having the following composition per liter of cleaning liquor:

30% laurylpyridinium chloride
15% isopropanol
15% butylglycol
20% perchloroethylene, and
20% water.

The cleaning liquor predominantly contained perchloroethylene as organic solvent.

The cleaning liquor was pump-circulated through a filter for 45 minutes. The filter used was a candle settling filter (laboratory type) which had been charged with 70 g of kieselguhr and 30 g of montmorillonite prepared with 15% by weight of benzylcetyldimethylammonium chloride.

Samples of the cleaning liquor were taken before and after filtration to determine the fatty acid, cleaning booster, and solids contents. In addition, the coloring of the samples was investigated (Lovibond method, red and yellow tints, 1 inch cell). The results are shown in Table 1.

COMPARISON EXAMPLE IV

A settling filter charged with 100 g of kieselguhr was used for filtration under the same conditions as in Example IV. The results are shown in Table 1.

COMPARISON EXAMPLE V

A settling filter charged with 70 g of kieselguhr and 30 g of powdered active carbon was used under the conditions as described in Example IV. The results are shown in Table 1.

Comparison of Example IV with Comparison Examples IV and V shows that distinctly better filtration results were obtained with the layered silicate charged with quaternary ammonium compounds than with filters containing kieselguhr or kieselguhr-active carbon mixtures as filtration aids. This is reflected in particular in the color tests wherein cleaning liquors filtered by the process according to the invention were almost colorless, whereas the dissolved dyes could only be removed to a limited extent by conventional filtration processes.

TABLE 1

Filtration Results

| Example No. | Fatty acid content in g/l | | Cleaning booster concentration in g/l | | Solids content g/l | | Color: Lovibond before | | Color: 1" cell after | |
|---|---|---|---|---|---|---|---|---|---|---|
| | before | after | before | after | before | after | red | yellow | red | yellow |
| II | 5 | 1 | 7 | 0 | 9.9 | 1.0 | — | — | — | — |
| C II* | 5 | 4 | 7 | 5 | 9.9 | 7.5 | — | — | — | — |
| III | 10 | 1 | 5 | 0 | 13.25 | 1.0 | — | — | — | — |
| C III* | 10 | 8 | 5 | 4 | 13.25 | 10.6 | — | — | — | — |
| IV | 8 | 3 | 5 | 0 | 9.5 | 3.0 | 2.4 | 6.1 | 0.8 | 1.8 |
| C IV* | 8 | 7 | 5 | 4 | 9.5 | 8.2 | 2.4 | 6.1 | 2.1 | 5.8 |
| C V* | 8 | 6 | 5 | 3 | 9.5 | 6.9 | 2.4 | 6.1 | 1.8 | 5.2 |

*C = Comparison Example

EXAMPLE V

In a standard dry cleaning machine (capacity 4 kg) with a built-in adsorption filter, 300 kg of fabrics were dry cleaned by the one-bath method in two series of tests. The cleaning liquor contained 1,1,1-trichloroethane as organic solvent. The following composition was added as a cleaning booster to the solvent used in a quantity of 0.5%, based on the weight of the machine load:

25% dodecylbenzenesulfonate (triethanolamine salt)
15% cetylstearyl alcohol containing 10 moles of ethylene oxide
15% ethylene glycol
30% mineral oil, and
15% water.

To enable the solvent quality and the dry-cleaning quality obtained with this solvent to be compared, the solvent was passed on the one hand through a filter which had been charged with a filtration aid comprising 50% active carbon and 50% of a layered silicate charged with 18% of lauryl pyridinium chloride, and, on the other hand (for comparison), through a filter which had been charged with 50% active carbon and 50% of the same layered silicate which had not been charged with a quaternary ammonium compound. The cleaning liquors were distilled after the last load.

In addition, solvent samples were taken from both cleaning liquors and the fabrics of the last load were assessed for odors and streakiness. The results are shown in Table 2 below.

TABLE 2

| Filtration Process | Example V Results: Solvent Assessment: solid residue | color Lovibond (1" cell): red | color Lovibond (1" cell): yellow | Fabric Assessment: odor | Fabric Assessment: streakiness |
|---|---|---|---|---|---|
| Conventional (uncharged layered silicate) | 2% | 2.1 | 5.4 | rancid | yes |
| Invention (charged layered silicate) | 0.5% | 0.95 | 2.0 | neutral | no |

Discussion: In the conventional dry cleaning process in which an active carbon uncharged layered silicate filter is used for filtration, the dry-cleaned fabrics show streaks and, in addition, have an unpleasant smell on account of the high residue of solids and the resulting, relatively dark color of the cleaning liquor. To enable these disadvantages to be avoided, the cleaning liquor would have had to be distilled and the filter replaced after a very mcuh smaller number of dry cleaning cycles.

By contrast, in the process according to the invention, the solvent is in good condition and the dry-cleaned fabrics turn out satisfactorily. Distillation of the cleaning liquor filtered by the process according to the invention would still not be necessary at this stage.

EXAMPLE VI

A test cleaning liquor was prepared which contained as organic solvent trichloroethylene to which 10 g of tallow fatty acid per liter or organic solvent had been added. In addition, the solvent was bright red in color through the detachment of a naphthol-based fabric dye. The cleaning liquor was pump-circulated for 2 hours through a filter which was charged solely with a hectorite containing 5% by weight of lauryltrimethylammonium chloride as quaternary ammonium compound. After filtration, samples were taken from the test cleaning liquor and tested for their solids content and their coloration. The results are shown in Table 3 below.

COMPARISON EXAMPLE VI

Under the same test conditions as in Example VI, the test cleaning liquor was pumped through a filter which had been charged with 70% of kieselguhr and 30% of powdered active carbon. After filtration, samples of the cleaning liquor were taken and assessed by comparison with the starting sample. The results are shown in Table 3 below.

TABLE 3

| Process (Example) | Fatty acid content: before | Fatty acid content: after | Liquor coloration: before | Liquor coloration: after |
|---|---|---|---|---|
| Invention (VI) | 10 g/l | 0.8 g/l | dark red | colorless |
| Conventional (C VI*) | 10 g/l | 6.2 g/l | dark red | pink |

*C = Comparison Example

Result: The considerable reduction in the fatty acid content, and particularly in the dye content of the test cleaning liquor is a clear reflection of the advantages of the process according to the invention.

What is claimed is:

1. A process for the filtration of a liquor containing an organic solvent used in dry cleaning comprising:

(a) treating a layered silicate having an exchange capacity for cations of at least about 30 meq/100 g of layered silicate with one or more ammonium compound corresponding to the following formula $$R^1R^2R^3R^4N^+X^- \quad (I)$$

wherein $R^1$, $R^2$, $R^3$ and $R^4$ represent hydrogen, an alkyl or alkenyl group, two or three of the substituents $R^1$ to $R^4$ are closed with inclusion of the nitrogen atom to form an aliphatic or aromatic heterocyclic ring system; said alkyl or alkenyl group is branched or unbranched and contains a cycloalkyl group or aryl group, or an ether bond, amine bond, amide bond or ester bond or is substituted by a hydroxyl group or halide and contains from 1 to 18 carbon atoms, the total number of carbon atoms in the cation being greater than 12, and $X^-$ represents an anion of a water-soluble acid having a dissociation constant of greater than $10^{-5}$ in a quantity of from 2 to 60% by weight, based on the weight of said layered silicate;

(b) charging a settling filter or a cartridge filter with the treated layer silicate, and (c) filtering said liquor through said filter containing the treated layer silicate.

2. A process in accordance with claim 1 wherein said layered silicate comprises a mica-like layered silicate having a 3-layer structure selected from the smectite group.

3. A process in accordance with claim 2 wherein said layered silicate is selected from the group consisting of montmorillonite, saponite, beidellite, and hectorite.

4. A process in accordance with claim 1 wherein said layered silicate has a cation exchange capacity of from about 50 to about 120 meq/100 grams of said layered silicate.

5. A process in accordance with claim 1 wherein said layered silicate is selected from the group consisting of a vermiculite and a phyllosilicate.

6. A process in accordance with claim 1 wherein said layered silicate has been treated with from between about 5 to about 30 percent by weight of said ammonium compound, based on the weight of the treated layered silicate.

7. A process in accordance with claim 1 wherein said ammonium compound contains a total of from 14 to 38 carbon atoms.

8. A process in accordance with claim 1 wherein at least two of said substituents $R^1$ to $R^4$ represent a $C_1$–$C_3$ alkyl group, and one or two of said substituents represent(s) a $C_9$–$C_{18}$ alkyl group.

9. A process in accordance with claim 1 wherein said anion is selected from the group consisting of chloride, bromide, acetate, hydrogen sulfate, and hydrogen phosphate.

10. A process in accordance with claim 1 wherein said ammonium compound is selected from the group consisting of lauryltrimethylammonium chloride, distearyldimethylammonium chloride, cetyldimethylbenzyl- ammonium chloride, and laurylpyridinium chloride.

11. A process in accordance with claim 1 wherein said filter is charged with a mixture of kieselguhr and said treated layered silicate in a ratio of from 80:20 to 50:50 parts by weight.

12. A process in accordance with claim 1 wherein said filter is charged with a mixture of active carbon and said treated layered silicate in a ratio of from 80:20 to 50:50 parts by weight.

* * * * *